United States Patent [19]

Schaberg et al.

[11] Patent Number: 5,062,615

[45] Date of Patent: Nov. 5, 1991

[54] APPARATUS FOR THE INTRODUCTION OF REAGENTS IN POWDER FORM INTO A MELTING PAN

[75] Inventors: Frank Schaberg; Heribert Martens, both of Oelde; Peter Pöhlmann, Munster, all of Fed. Rep. of Germany

[73] Assignee: Krupp Polysius AG, Fed. Rep. of Germany

[21] Appl. No.: 584,365

[22] Filed: Sep. 17, 1990

Related U.S. Application Data

[63] Continuation of Ser. No. 345,442, May 1, 1989, abandoned.

[30] Foreign Application Priority Data

May 20, 1988 [DE] Fed. Rep. of Germany ..... 3817358

[51] Int. Cl.[5] ..... C21C 5/32

[52] U.S. Cl. ..... 266/217; 266/225

[58] Field of Search ..... 266/216, 218, 225, 217

[56] References Cited

U.S. PATENT DOCUMENTS

| | | | |
|---|---|---|---|
| 3,145,245 | 8/1964 | Chedaille | 266/225 |
| 3,545,960 | 12/1970 | McClellan et al. | 266/216 |
| 3,627,294 | 12/1971 | Hill | 266/225 |

*Primary Examiner*—S. Kastler

*Attorney, Agent, or Firm*—Learman & McCulloch

[57] ABSTRACT

The invention relates to apparatus for the introduction of reagents in powder form into a melting pan, in which the lance is arranged eccentrically with respect to the pan axis and the outlet nozzles are directed into the larger region of the pan enclosing the pan axis. Such apparatus is distinguished by optimum mixing in of the added reagents.

4 Claims, 1 Drawing Sheet

APPARATUS FOR THE INTRODUCTION OF REAGENTS IN POWDER FORM INTO A MELTING PAN

This is a continuation of copending application Ser. No. 07/345,442 filed on May 1, 1989 now abandoned.

The invention relates to improvements in apparatus for the pneumatic introduction of reagents in powder form into a melting pan.

BACKGROUND OF THE INVENTION

In the treatment of melts with injected reagents in powder form, for example in the desulphurisation of crude iron or the treatment of steel, optimum introduction of the reagents is necessary in order to achieve the best possible utilisation of the reagents so as to reduce the process costs as much as possible.

In the past reagents were introduced by means of a vertical lance arranged centrally with respect to the pan axis, the reagents either being introduced downwards through a vertical nozzle orifice or through one or more nozzle orifices evenly distributed around the periphery of the lance.

The object of the invention is to construct apparatus in such a way that the introduction of the reagents in powder form into the melting pan is improved so as to produce a particularly favourable intermixing.

SUMMARY OF THE INVENTION

According to the invention the lance is arranged eccentrically with respect to the pan axis, and the outlet nozzle or nozzles are directed into the larger region of the pan which faces away from the peripheral wall of the pan near the lance and encloses the pan axis.

Using such a solution the melt intermixing time is substantially reduced by comparison with known constructions because the progress of the intermixing is more favourable as a result of the altered flow profile.

A reduction of the specific quantities added is also achieved by the increased accuracy provided by the apparatus according to the invention.

THE DRAWINGS

The invention will be explained in greater detail below with the aid of the drawings, in which.

DETAILED DESCRIPTION

Figure 1:
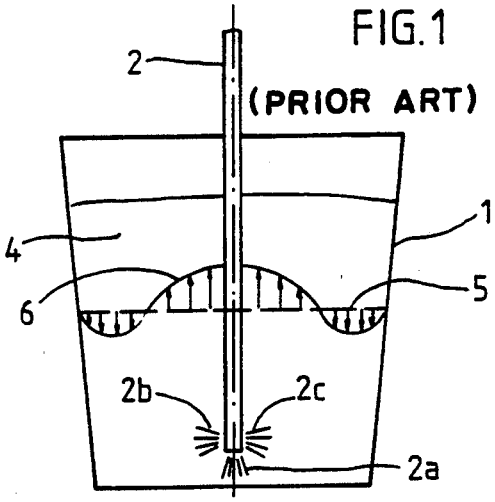
FIG. 1 (PRIOR ART)
FIGS. 1 and 2 show a section and a plan view of known apparatus.
Figure 2:
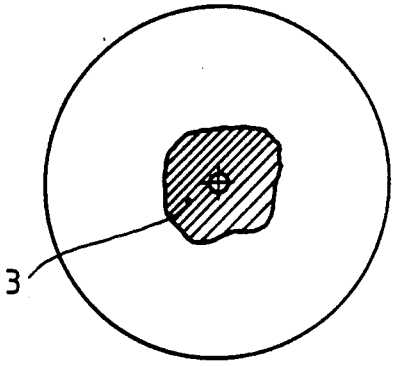
FIG. 2 (PRIOR ART)
Figure 3:
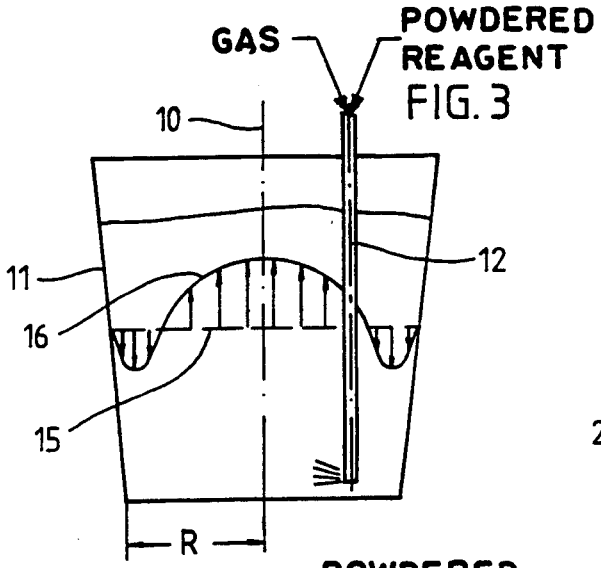
FIGS. 3 and 4 show a section and a plan view of apparatus according to the invention.

FIGS. 1 and 2 show the known prior art which forms the starting point for the invention. A lance 2, which is arranged vertically and centrally with respect to the axis of the melting pan 1 and is provided at its lower end with a downwardly-directed nozzle orifice 2*a* and a plurality of horizontal nozzle orifices, e.g. 2*b*, 2*c*, evenly distributed about the periphery, serves for the introduction of reagents in powder form into a melting pan 1.

The hatched area 3 in FIG. 2 extends approximately uniformly about the lance 2 and is a so called "scavenging spot", i.e. a region in which the reagents blown out of the nozzle orifices enter the melt 4.

The reagents in powder form which are blown in pneumatically are moved upwards in the melt 4 by the carrier air, producing a division of the flow at the level marked by the broken line 5, as indicated schematically by the curve 6. In the central region the flow is directed upwards, whilst in a comparatively wide annular edge zone it is directed downwards.

By contrast, FIGS. 3 to 6 show the apparatus according to the invention.

The lance 12 is arranged eccentrically with respect to the axis 10 of the melting pan 11, as much as 0.2 to 0.8 times the pan radius R preferably offset with respect to the pan axis 10 by 0.4 to 0.6 times the pan radius R (measured on the base of the pan).

In the illustrated embodiment the lance 12 is provided at its lower end with two outlet nozzles 12*a*, 12*b* which are offset with respect to one another by an angle of between 60° and 120°, preferably by an angle between 80° and 100°, with the angle bisector 20 intersecting the pan axis 10.

Figure 4:
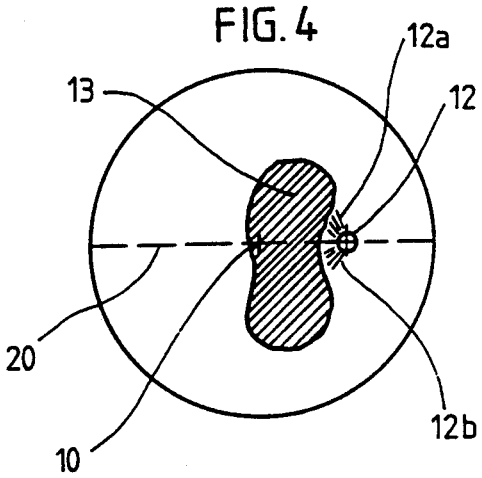
Figure 5:
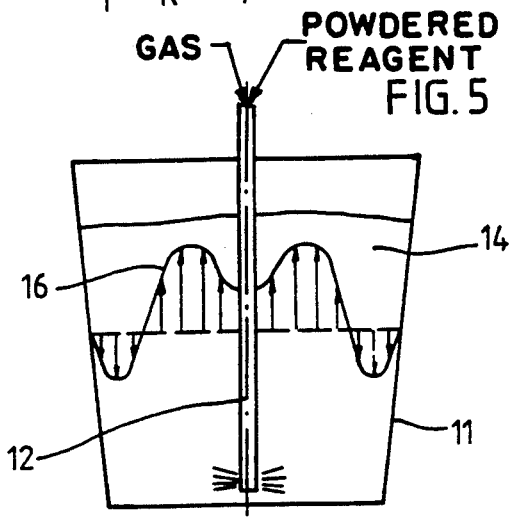
FIGS. 5 and 6 show a section and a plan view of the apparatus according to the invention (rotated by 90° with respect to the views in FIGS. 3 and 4).
Figure 6:
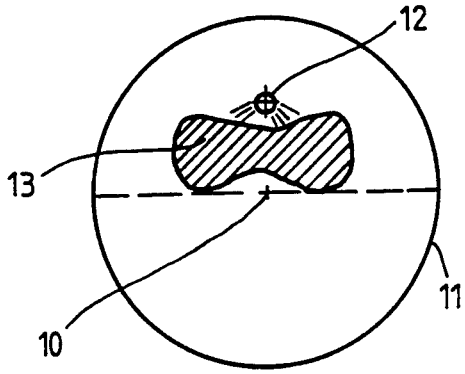

As FIG. 4 shows, the two outlet nozzles 12*a*, 12*b* are aligned in the larger region of the pan 11 which faces away from the peripheral wall of the pan 11 near the lance 11 and encloses the pan axis, so that an elongated scavenging spot characterised by the area 13 is produced with its narrow extent reaching for the lance 12 to approximately over the axis 10 and its elongated extent running at right angles thereto.

If one considers the flow at the level of the line 15, the relationships characterised by the curve 16 are established. A further characteristic of this is the dip in the curve 16 which can be seen in the view according to FIG. 5 which is rotated by 90°. Generally speaking, it can be established that in the construction according to the invention the reagents in powder form which are blown in are distributed better and more rapidly in the melt 14 and localised overconcentrations are avoided.

What is claimed is:

1. Apparatus for the introduction of powdered reagents into a melting pan containing a melt and having a cylindrical base and a vertical center axis, said melt having its surface at a predetermined level above the base of said pan, said apparatus comprising a source of gas and powdered reagent, a lance projecting downwardly into said pan with its lower end portion forming a delivery outlet at a level between the surface of said melt and said base, and means communicating with said lance and said source for pneumatically supplying a gas and a powdered reagent to said lance for discharge through the delivery outlet of said lance into said melt, said lance being offset eccentrically of said axis of said pan, said delivery outlet of said lance comprising a pair of circumferentially spaced outlet nozzles at said lower end portion, each of said nozzles being directed wholly radially outwardly of said lance below the surface of said melt, one of said nozzles opening in a direction to one side of said axis and the other of said nozzles opening in a direction to the opposite side of said axis, said nozzles being spaced from one another at an angle in the range of 60° to 120°, said angle having its bisector intersecting said axis.

2. The apparatus of claim 1 wherein said nozzles are offset from one another at an angle in the range of 80° to 100°.

3. The apparatus of claim 1 wherein said lance is offset from said vertical pan axis a distance in the range of 0.2 to 0.8 times the radius of the base of said pan.

4. The apparatus of claim 1 wherein said lance is offset from said vertical pan axis a distance in the range of 0.4 to 0.6 times the radius of the base of said pan.

* * * * *